US009663327B2

(12) United States Patent
Terry et al.

(10) Patent No.: US 9,663,327 B2
(45) Date of Patent: May 30, 2017

(54) ELEVATOR BRAKING SYSTEM

(75) Inventors: Harold Terry, Avon, CT (US); Leandre Adifon, Farmington, CT (US); Richard N. Fargo, Plainville, CT (US); David J. Lanesey, Harwinton, CT (US); Anthony Cooney, Unionville, CT (US); James M. Draper, East Hartford, CT (US); Jamie A. Rivera, Bristol, CT (US); Justin Billard, Amston, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 261 days.

(21) Appl. No.: 14/006,461

(22) PCT Filed: Mar. 22, 2011

(86) PCT No.: PCT/US2011/029354
§ 371 (c)(1),
(2), (4) Date: Sep. 20, 2013

(87) PCT Pub. No.: WO2012/128758
PCT Pub. Date: Sep. 27, 2012

(65) Prior Publication Data

US 2014/0008157 A1 Jan. 9, 2014

(51) Int. Cl.
*B66B 5/22* (2006.01)
*B66B 5/18* (2006.01)
(Continued)

(52) U.S. Cl.
CPC ..... *B66B 5/22* (2013.01); *B66B 5/04* (2013.01); *B66B 5/18* (2013.01); *B66B 5/20* (2013.01)

(58) Field of Classification Search
CPC ..... B66B 5/22
See application file for complete search history.

(56) References Cited

U.S. PATENT DOCUMENTS 3,249,179 A * 5/1966 Borgman ..... B66B 5/22 187/372
3,706,361 A * 12/1972 Paulssen ..... F16D 63/008 188/189

(Continued)

FOREIGN PATENT DOCUMENTS

CA 2613124 A1 6/2008
CN 1235732 A 11/1999

(Continued)

OTHER PUBLICATIONS

European Supplemental Search Report for application EP 11861493.2, dated Nov. 5, 2014, 5 pages.

(Continued)

*Primary Examiner* — Minh Truong
(74) *Attorney, Agent, or Firm* — Cantor Colburn LLP

(57) ABSTRACT

An elevator system includes one or more rails fixed in a hoistway and an elevator car configured to move through the hoistway along the one or more rails. The system includes one or more braking systems having one more braking surfaces secured to the elevator car and frictionally engageable with one or more rails of the elevator system. One or more actuators are operably connected to the one or more braking surfaces configured to urge engagement and/or disengagement of the one or more braking surfaces with the rail to stop and/or hold the elevator car during operation of the elevator system.

8 Claims, 10 Drawing Sheets

(51) Int. Cl.
*B66B 5/20* (2006.01)
*B66B 5/04* (2006.01)

(56) References Cited

U.S. PATENT DOCUMENTS

| | | | | | |
|---|---|---|---|---|---|
| 5,096,020 | A * | 3/1992 | Korhonen | B66B 5/22 | 187/359 |
| 5,648,644 | A | 7/1997 | Nagel | | |
| 5,782,319 | A | 7/1998 | Woodruff et al. | | |
| 6,092,630 | A * | 7/2000 | Wendel | B66B 5/18 | 187/373 |
| 6,176,350 | B1 * | 1/2001 | Schlosser | B66B 5/20 | 187/359 |
| 7,131,517 | B1 * | 11/2006 | de Asis Mateo Mur | B66B 5/22 | 187/356 |
| 7,299,898 | B2 * | 11/2007 | Husmann | B66B 5/20 | 187/365 |
| 7,398,863 | B2 * | 7/2008 | Liebetrau | B66B 7/046 | 187/367 |
| 7,650,969 | B2 * | 1/2010 | Monzon | B66B 5/06 | 187/300 |
| 8,312,972 | B2 * | 11/2012 | Gremaud | B66B 5/22 | 187/371 |
| 9,120,643 | B2 * | 9/2015 | Meierhans | B66B 5/18 | |
| 2007/0089938 | A1 * | 4/2007 | Ishioka | B66B 5/18 | 187/391 |
| 2008/0128218 | A1 * | 6/2008 | Gremaud | B66B 5/22 | 187/250 |
| 2011/0088983 | A1 * | 4/2011 | Sirigu | B66B 5/22 | 187/373 |
| 2012/0152663 | A1 * | 6/2012 | Legeret | B66B 5/20 | 187/404 |
| 2014/0158476 | A1 * | 6/2014 | Wei | B66B 5/22 | 188/65.1 |

FOREIGN PATENT DOCUMENTS

| | | | | |
|---|---|---|---|---|
| EP | 0648703 | A1 | 4/1995 | |
| EP | 1323660 | A1 | 7/2003 | |
| JP | H0472285 | A | 3/1992 | |
| JP | H0979226 | A | 3/1997 | |
| JP | 2004224492 | A | 8/2004 | |
| JP | 2008143706 | A | 6/2008 | |
| JP | 2008260595 | A | 10/2008 | |
| JP | 4410248 | B2 | 2/2010 | |
| JP | 2010083640 | A | 4/2010 | |
| JP | 2010109074 | A | 5/2010 | |
| KR | 200416358 | Y1 | 5/2006 | |
| WO | 2008011896 | A1 | 1/2008 | |
| WO | WO-2008057116 | A1 * | 5/2008 | B66B 5/22 |

OTHER PUBLICATIONS

Japanese First Office Action for application JP 2014-501050, dated Nov. 18, 2014, 3 pages.

Chinese Office Action for application 201180069409.3, dated Feb. 28, 2015, 9 pages.

Notification of Transmittal of the International Search Report and the Written Opinion of the International Searching Authority, or the Declaration; PCT/US2011/029354; Mar. 22, 2011.

KR Korean Office Action for application KR 10-2013-7027427, dated Dec. 10, 2014, 5 pages.

* cited by examiner

ELEVATOR BRAKING SYSTEM

BACKGROUND OF THE INVENTION

The subject matter disclosed herein relates to elevator systems. More specifically, the subject disclosure relates to braking systems for elevators.

Elevator systems are driven by a motor, referred to as a machine, which drives a lifting means, typically ropes or belts, attached to an elevator car. The speed and motion of the elevator car are controlled by a variety of devices scattered throughout the elevator system which are installed and adjusted individually. For example, a brake at the machine is used to stop and hold the elevator car during normal and emergency operation. A governor is located at an idler pulley in the hoistway or pit or machine room to detect over speed of the elevator car when it is in motion. Position reference systems on the elevator car and in the hoistway are used to gather data on the position of the elevator car, and safeties mounted on the elevator car are utilized to stop the car in the hoistway in the event of an emergency. Installation and setup of all of these separate devices is costly and time consuming.

BRIEF DESCRIPTION OF THE INVENTION

According to one aspect of the invention, a braking system for an elevator system includes one or more braking surfaces secured to an elevator car and frictionally engageable with a rail of an elevator system. One or more actuators are operably connected to the one or more braking surfaces configured to urge engagement and/or disengagement of the one or more braking surfaces with the rail to stop and/or hold the elevator car during operation of the elevator system.

According to another aspect of the invention, an elevator system includes one or more rails fixed in a hoistway and an elevator car configured to move through the hoistway along the one or more rails. The system includes one or more braking systems having one or more braking surfaces secured to the elevator car and frictionally engageable with one or more rails of the elevator system. One or more actuators are operably connected to the one or more braking surfaces configured to urge engagement and/or disengagement of the one or more braking surfaces with the rail to stop and/or hold the elevator car during operation of the elevator system.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
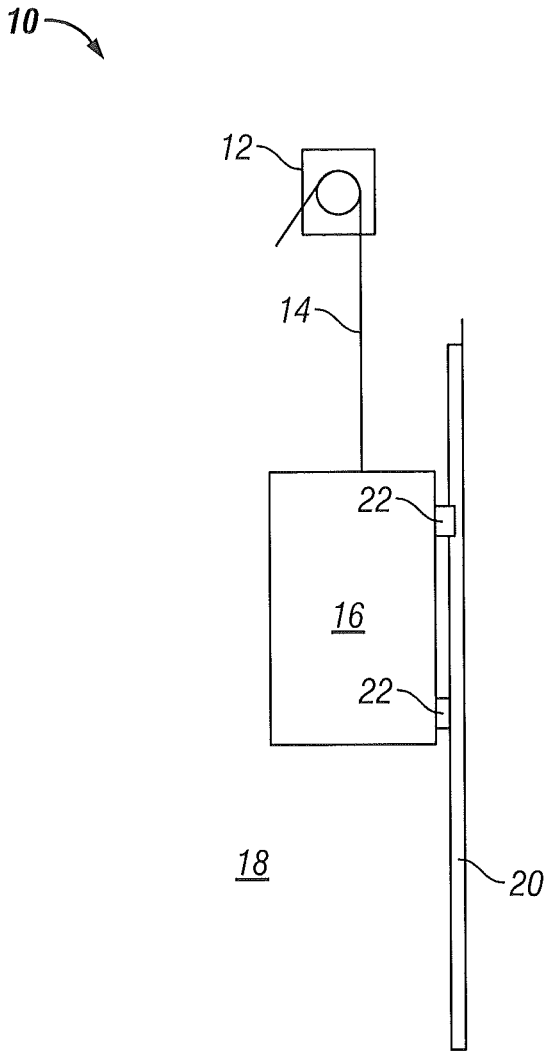
FIG. 1 is a schematic of an embodiment of an elevator system.

Shown in FIG. 1 is an embodiment of an elevator system 10. The elevator system 10 includes a motor for driving the elevator system, known as a machine 12. The machine 12 drives a lifting means, for example, one or more belts or ropes, hereinafter referred to as "ropes" 14 over one or more pulleys to urge motion of an elevator car 16 up and/or down in a hoistway 18. One or more rails 20, typically at least two rails 20, are located in the hoistway 18 and the elevator car 16 is positioned in the hoistway 18 such that the rails 20 guide the motion of the elevator car 16. A braking system, generally shown at 22, is secured to the elevator car 16. The braking system 22 interacts with the rails 20 to slow and/or stop the elevator car 16 during normal operation of the elevator 10, for example, stopping at a floor to load and/or unload passengers. Further, some embodiments of the braking system 22 include the function of a traditional emergency brake, or safety, to slow and/or stop movement of the elevator car 16 in the event of an emergency, for example, the elevator car 16 exceeding a predetermined speed, or in the event of a power failure of the elevator 10.

Figure 2:
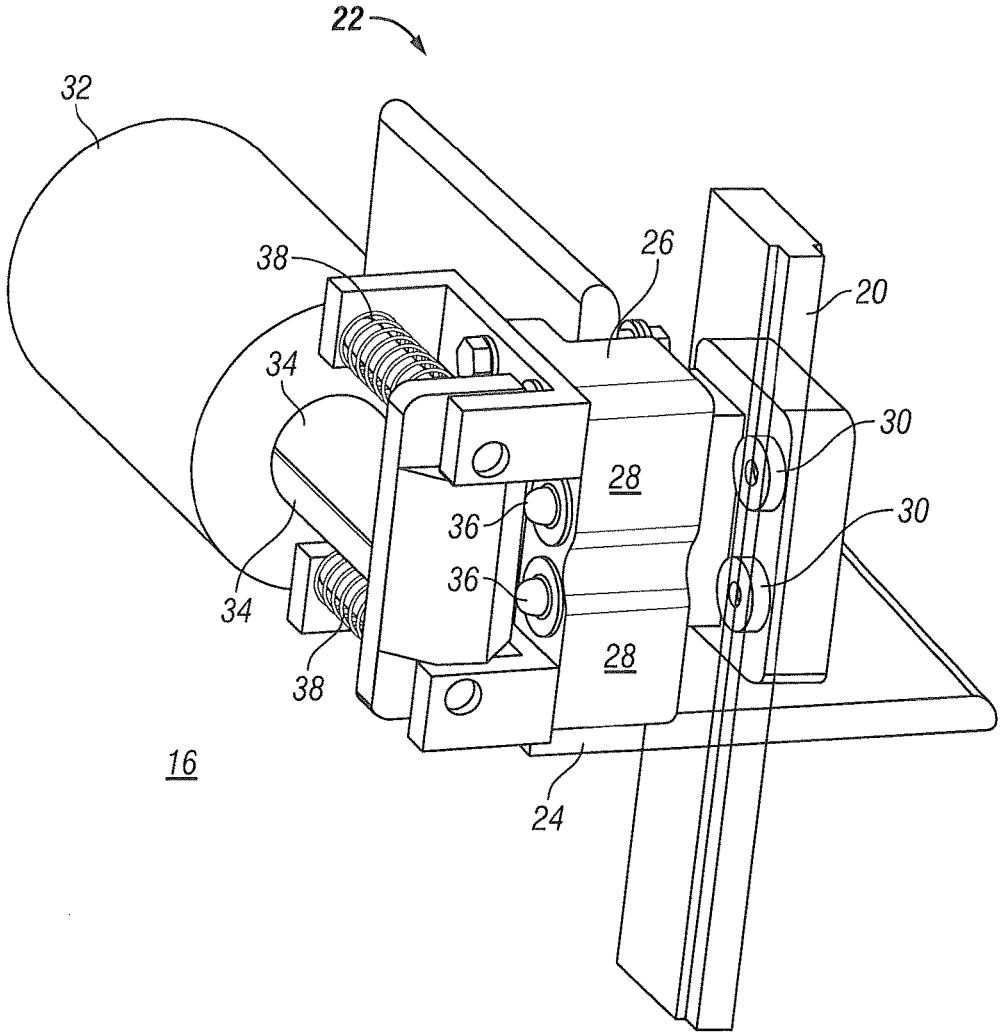
FIG. 2 is a perspective view of an embodiment of a brake for an elevator system.

Referring to FIG. 2, shown is an embodiment of a braking system 22. The braking system 22 is secured to the elevator car 16 via, for example a support 24 with the various components of the braking system 22 secured thereto. The braking system 22 includes a caliper 26 having one or more brake pads 28. The brake pads 28 are movable to engage the rail 20 between the brake pads 28 and one or more braking pads 30 on the opposite side of the rail 20. In some embodiments, the brake pads 28 are movable via a braking actuator 32. The braking actuator 32 may be, for example, a solenoid, a linear motor, or other type of actuator. The braking actuator 32 includes one or more braking actuator plungers 34 extending toward one or more brake pad pins 36. When the braking actuator 32 is energized, such as during operation of the elevator 10, the braking actuator plungers 34 are drawn into the braking actuator 32. When it is desired to activate the braking system 22, the braking actuator 32 is de-energized. One or more plunger springs 38 bias the braking actuator plungers 34 outwardly, away from actuator 32, urging them into an extended position. As the braking actuator plungers 34 move outwardly, the braking actuator plungers 34 come into contact with the brake pad pins 36 and urge the brake pad pins 36 toward the rail 20. The brake pad pins 36 in turn move the brake pads 28 into contact with the rail 20 and slow and/or stop movement of the elevator car 16 relative to the rail 20 by frictional forces between the brake pads 28 and the rail 20 and between the braking pads 30 and the rail 20. To deactivate the brake, the braking actuator 32 is energized, drawing the braking actuator plungers 34 into the actuator 32, overcoming the bias of the plunger springs 38, thus allowing the brake pads 28 to move away from the rail 20.

In some embodiments, the braking actuator plunger 34 is split into two or more braking actuator plungers 34 extending from a single braking actuator 32. Each braking actuator plunger 34 can interact independently with a separate brake pad 28, providing redundancy in the braking system 22.

Figure 3:
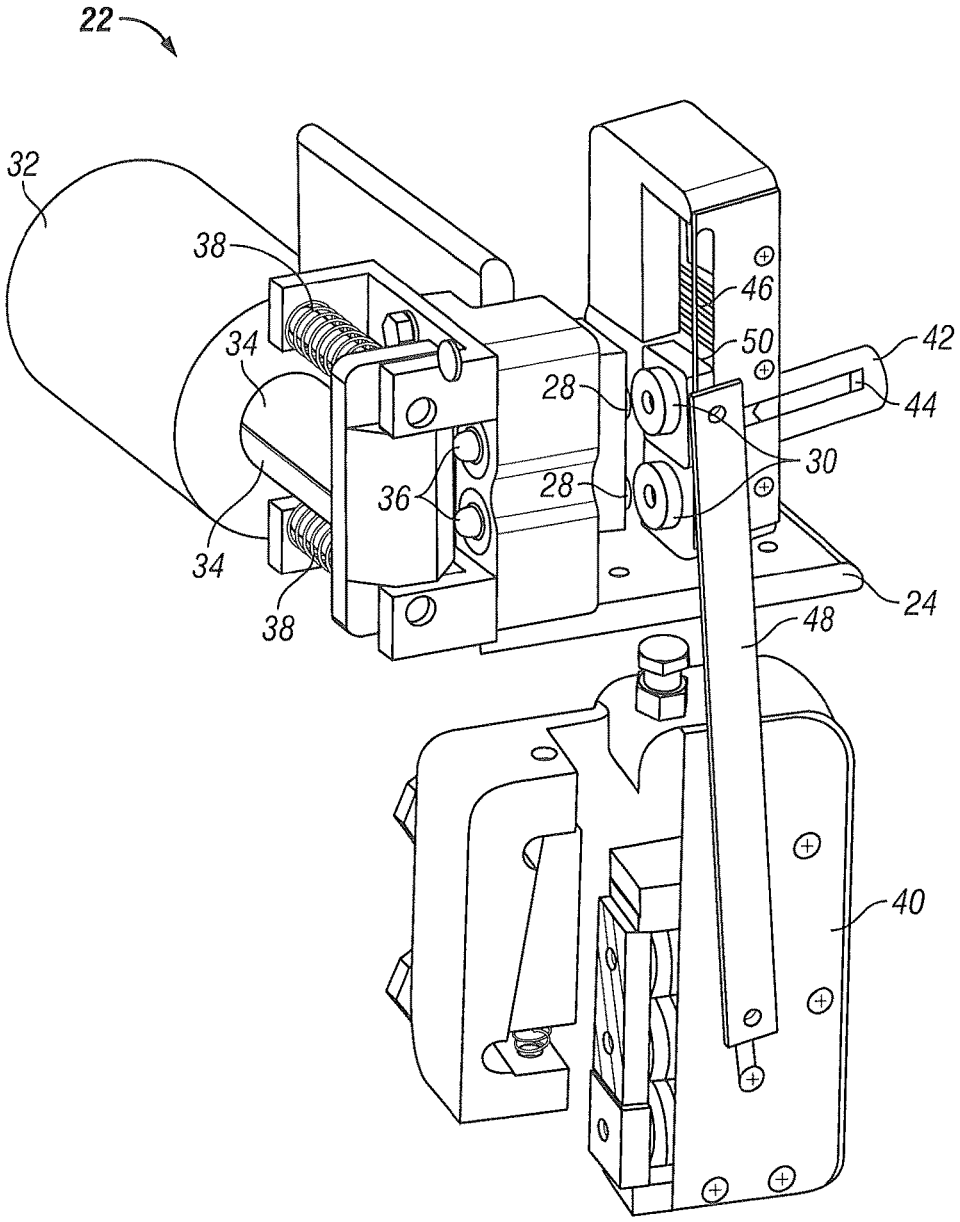
FIG. 3 is a perspective view of an embodiment of a brake for an elevator system connected to a safety.

As shown in FIG. 3, in one embodiment, a braking block 30 may be connected to a safety 40. Many aspects of the braking system shown in FIG. 2, such as plunger 34, plunger springs 38, and brake pad pins 36, are included in this embodiment as well. In this example, a safety actuator 42 includes a safety plunger 44 which retains the braking block 30 when the safety plunger 44 is extended toward the braking block 30, for example, into a plunger hole 46 in the braking block 30. The braking block 30 is connected to the safety 40 via a trip rod 48. When it is desired or necessary to engage the safety 40 with the rail 20, the safety actuator 42 is energized, thus drawing the safety plunger 44 away from the braking block 30. This allows the braking block 30 to translate along the rail 20 through friction with the rail 20. Translation of the braking block 30 along the rail 20 pulls the trip rod 48 which activates the safety 40. When the brake pads 28 are released, gravity will reset the braking block 30, trip rod 48, and safety 40. The safety actuator 42 is de-energized to retain the braking block 30 in the home position.

Figure 4:
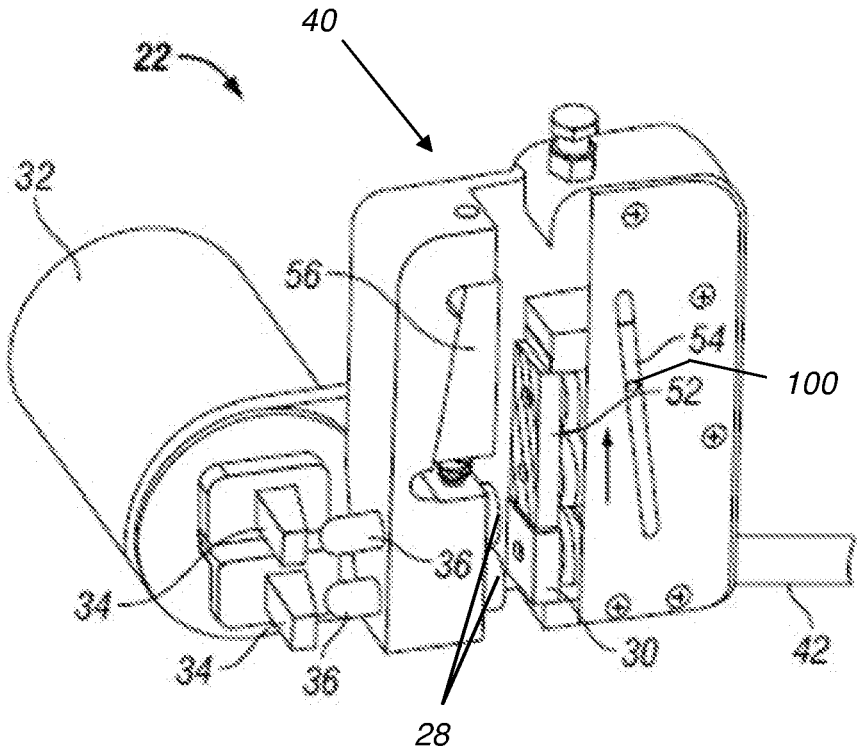
FIG. 4 is a perspective view of a brake for an elevator system with an integrated safety.

Referring to FIG. 4, in some embodiments, the brake pads 28 and safety 40 may be combined into a single unit. This embodiment includes the braking actuator 32 to move the brake pads 28 toward the rail 20 by mechanical interactions between de-energized actuator 32, plungers 34, and pins 36 similar to those described above with respect to FIGS. 2 and 3, and the braking blocks 30. If it is desired to engage the safety 40, a safety actuator 42 is activated which allows braking block 30 to move along the rail 20 in the direction of the arrow shown in FIG. 4 via frictional interaction with the rail 20. This movement of the braking block 30 urges a safety block 52 to travel along a direction parallel to a slot 54 into contact with the rail 20 via safety block pin 100 disposed in the slot 54 and operably connected to the safety block 52. The rail 20 will be held between the safety block 52 and a safety wedge 56.

Figure 5:
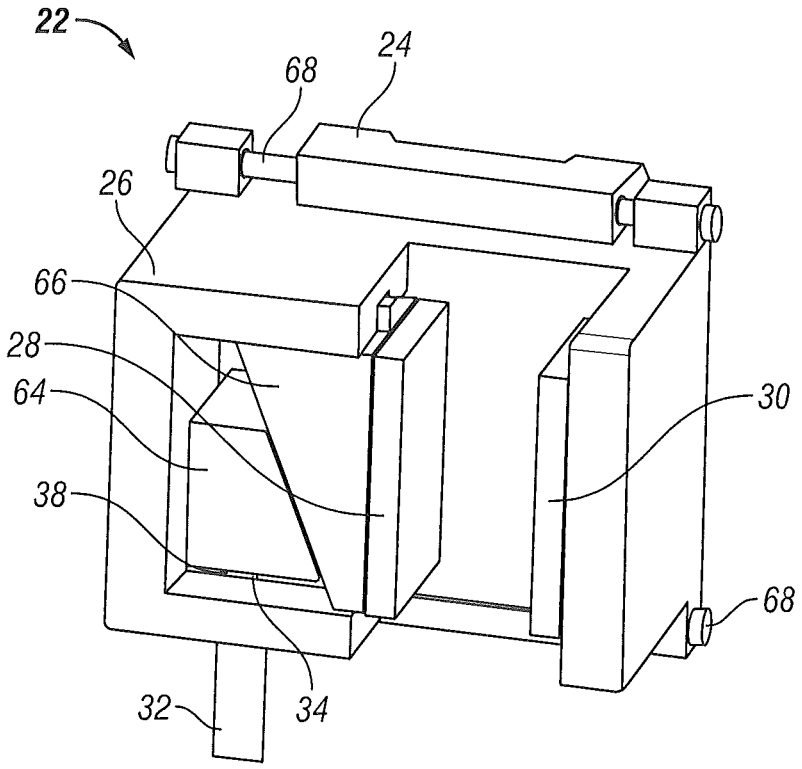
FIG. 5 is a perspective view of an embodiment of a wedge-driven brake for an elevator system.
Figure 6:
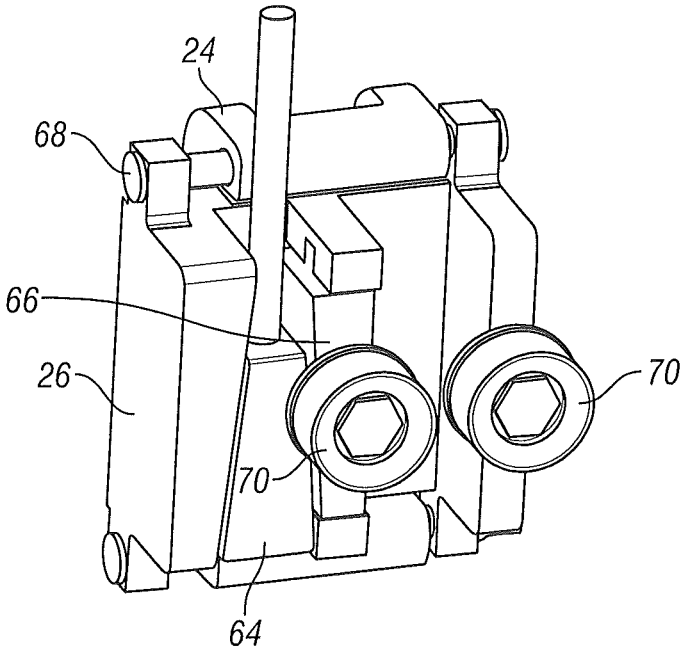
FIG. 6 is a perspective view of an embodiment of a brake for an elevator system using rollers.

Shown in FIG. 5 is an embodiment utilizing a braking wedge 64 housed within a caliper 26 to move the brake pad 28 into contact with the rail 20. The braking wedge 64 is connected to the braking actuator 32 via the braking actuator plunger 34. The plunger spring 38 biases the braking wedge 64 in an engaged direction. The braking wedge 64 abuts a complimentary brake pad wedge 66 to which the brake pad 28 is fixed. When the braking actuator 32 is de-energized, the plunger spring 38 urges the braking wedge 64 away from the braking actuator 32, which pushes the brake pad wedge 66 and the brake pad 28 into contact with the rail 20 where frictional forces between the brake pad 28 and rail 20 and between the braking pad 30 and the rail 20 slow or stop the elevator car 16 (not shown in FIG. 5). In some embodiments, the caliper 26 is slidably connected to the support 24 by one or more support pins 68. Shown in FIG. 6, rather than braking pads 28, some embodiments may use braking rollers 70 to slow or stop the elevator car 16.

Figure 7:
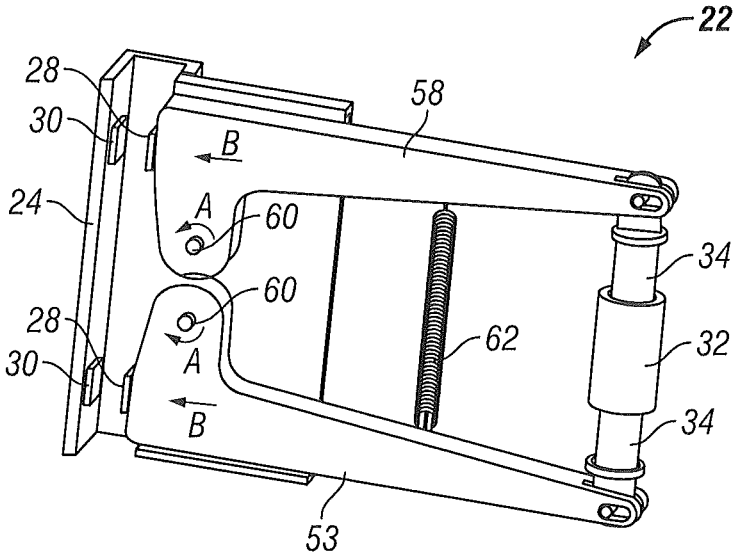
FIG. 7 is a perspective view of an embodiment of a brake for an elevator system having brake arms.

Referring to FIG. 7, some embodiments of the braking system 22 may include two or more brake arms 58 secured to the support 24 which is secured to the elevator car 16 (not shown in FIG. 7). The brake arms 58 are pivotably secured to the support 24 at arm pivots 60. Each brake arm 58 includes a brake pad 28 which, when the braking system 22 is activated, moves toward the rail 20 and slows or stops the movement of the elevator car 16 relative to the rail 20 by frictional forces between the brake pads 28, one or more braking pads 30 secured to the support 24, and the rail 20. An arm spring 62 extends between the brake arms 58 and biases the brake pads 28 toward the rail 20. A braking actuator 32 (alternatively one actuator could be attached to each arm) is located between the brake arms 58 with a braking actuator plunger 34 connected to each brake arm 58. During operation of the elevator 10, the braking actuator 32 is energized, drawing the braking actuator plungers 34 inwardly and thus rotating the brake arms 58 around the arm pivots 60 such that the brake pads 28 move away from the rail 20. When it is desired to activate the braking system 22, the braking actuator 32 is de-energized and the arm spring 62 forces the brake arms 58 to rotate about the arm pivots 60 (as shown by arrows "A") so that the brake pads 28 contact the rail 20 (as shown by arrow B) and slow or stop the elevator car 16.

Figure 8:
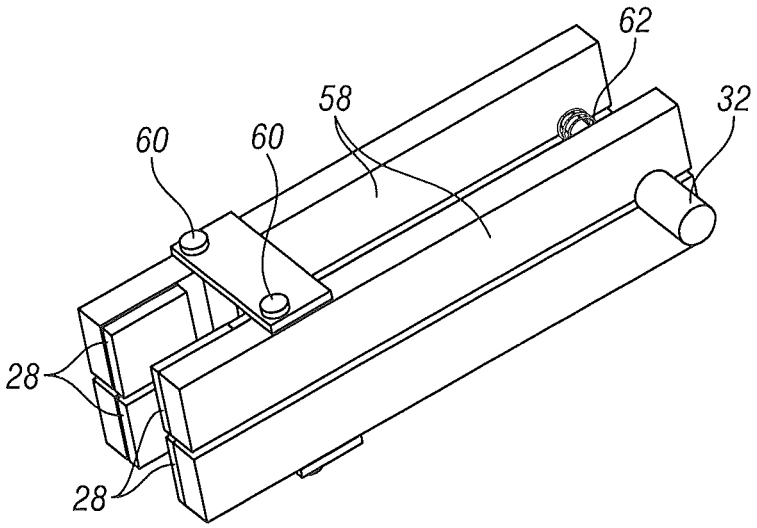
FIG. 8 is a perspective view of another embodiment of a brake for an elevator system having brake arms.

Another embodiment is shown in FIG. 8. In this embodiment, the brake arms 58 are located two on either side of the rail 20. When the braking actuator 32 is energized, the braking actuator plunger 34 (not shown) overcomes the force of arm spring 62 and rotates the brake pads 28 away from the rail 20 and away from each other. When the braking actuator 32 is de-energized, the arm spring 62 rotates the braking arms 58 about the arm pivots 60 and brings the brake pads 28 into contact with the rail 20 to slow or stop the elevator car 16. To provide redundancy, multiple braking arms 58 may be provided at each side of the rail 20, which in some embodiments may be coupled to multiple braking actuators 32 and/or multiple arm springs 62.

Figure 9:
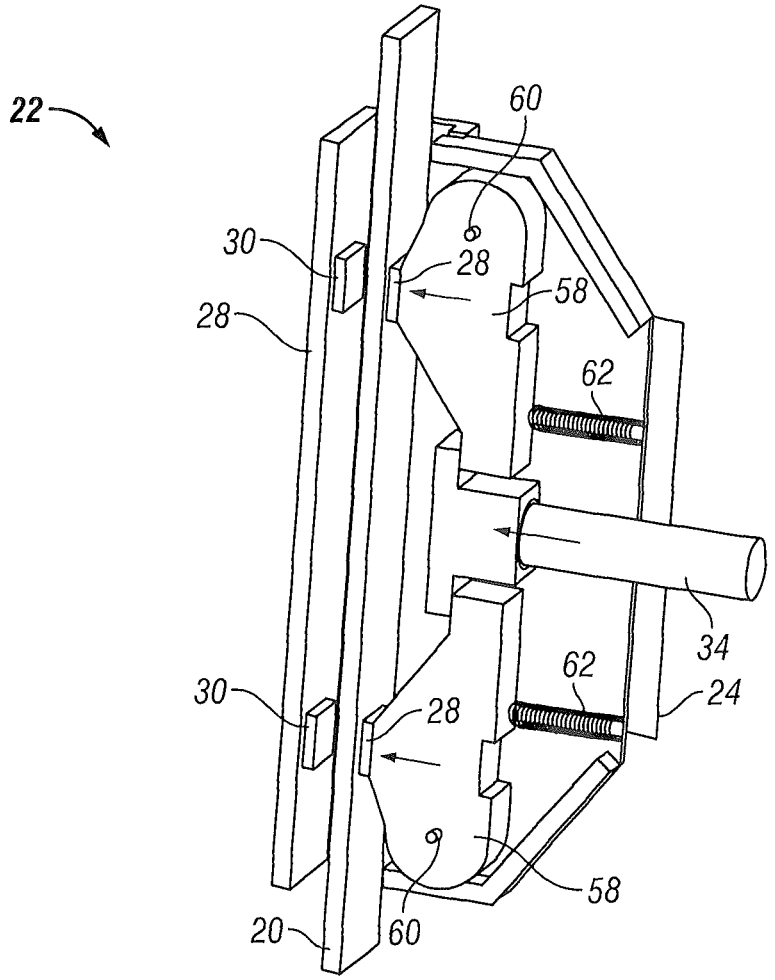
FIG. 9 is a perspective view of yet another embodiment of a brake for an elevator system having brake arms.

FIG. 9 illustrates another embodiment of braking system 22 where braking arms 58 are arranged substantially along the rail 20, and generally vertically disposed. The braking actuator plunger 34 extends between the braking arms 58 and, when the actuator (not shown) is energized, overcomes the bias of arm springs 62 which are connected to, for example, the support 24 such that the braking arms are pivoted away from the rail 20 and brake pads 28 do not contact the rail 20. When the braking actuator is de-energized, the arm springs 62 urge rotation of braking arms toward the rail 20, which in turn pushes the brake pads 28 into contact with the rail 20. To disengage the brake pads 28 from the rail 20, the braking actuator is energized, so that plunger 34 urges the braking arms 58 to rotate in a direction shown by arrows A around arm pivots 60, which in turn moves the brake pads 28 away from the rail 20.

Figure 10:
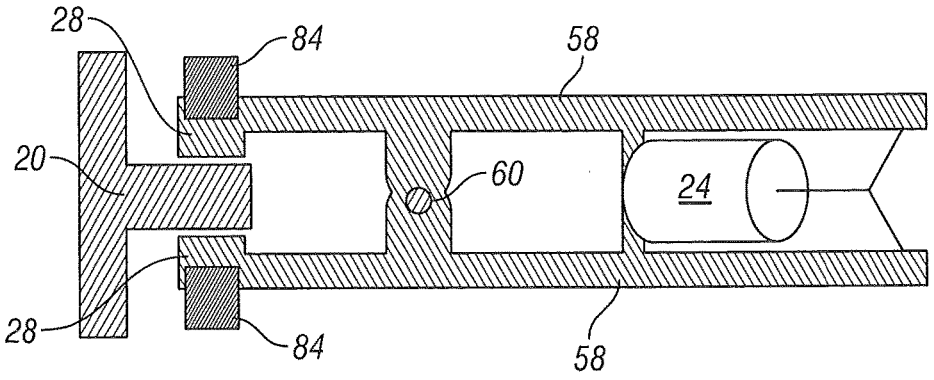
FIG. 10 is a plan view of another embodiment of an elevator braking system.
Figure 11:
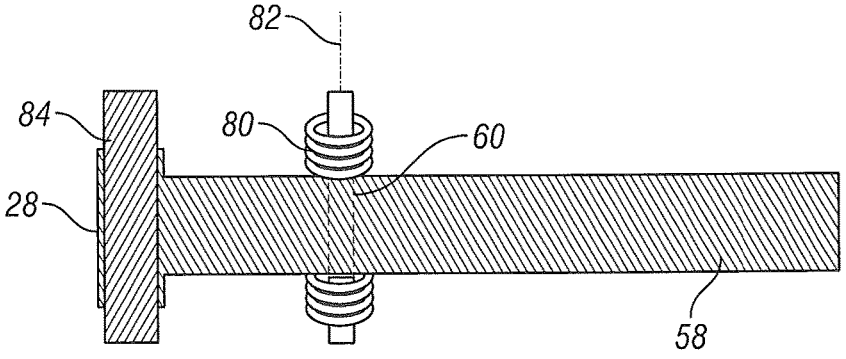
FIG. 11 is a side view of the elevator braking system of FIG. 10.
Figure 12:
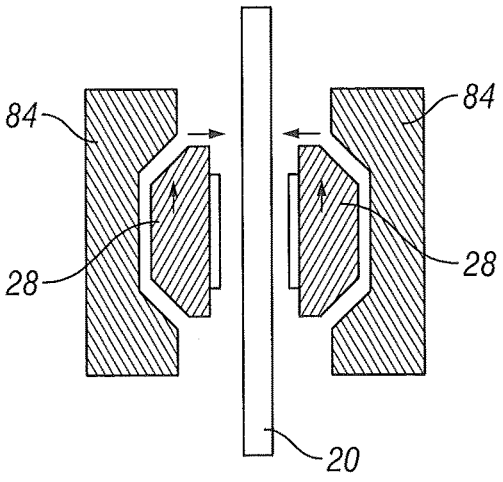
FIG. 12 is an end view of the elevator braking system of FIG. 10.

In yet another embodiment illustrated in FIGS. 10-12, a pivot spring 80 extends through the braking arms 58 at the pivot 60. The pivot spring 80 is preloaded to prevent movement of the brake arms 58 along a pivot spring axis 82 during normal operation of the elevator system 10. In such conditions, the braking system 22 engages the rail 20 when the braking actuator 24 is de-energized, thereby allowing the braking arms 58 to rotate about the pivot 60 so the brake pads engage the rail 28. If the speed of the elevator car (not shown) exceeds a desired limit, the braking forces applied by the de-energizing of the braking actuator 24 may not be sufficient to stop the elevator car. In such cases, friction between the rail 20 and the brake pads 28 will result in forces overcoming the preload of the pivot spring 80, and allow movement of the brake arms 58 along the pivot spring axis 82. As a result, the brake pads 28 engage with braking wedges 84, the braking wedges 84 configured to force the brake pads 28 closer to the rail 20 resulting in an addition of braking force to stop the elevator car.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A braking system for an elevator system comprising:

a first braking surface secured to an elevator car or frame and frictionally engageable with a first side of a rail of the elevator system;

a second braking surface secured to the elevator car or frame and frictionally engageable with a second side of the rail, opposite the first side;

a braking actuator operably connected to the first braking surface configured to urge engagement and/or disengagement of the first braking surface with the rail to stop and/or hold the elevator car during operation of the elevator system, wherein the braking actuator is a solenoid; and a safety of the elevator operably connected to the second braking surface; wherein the second braking surface is operably connected to and translatable along a braking device slot via a pin disposed in the braking device slot and operably connected to the safety, the braking device slot is positioned nonparallel to the rail;

wherein the second braking surface is movable along the braking system parallel to the slot via a safety actuator and via frictional interaction with the rail, the second braking surface urging movement of one or more surfaces of the safety into engagement with the rail; and wherein the braking system is asymmetric about a longitudinal axis disposed at a centerline of the rail.

2. The braking system of claim 1, including a plunger associated with the solenoid configured to urge the first braking surface away from the rail, when the associated solenoid is energized.

3. The braking system of claim 1, including one or more plunger springs configured to urge the first braking surface into contact with the rails.

4. The braking system of claim 1, wherein the first safety surface includes a safety wedge.

5. An elevator system comprising:

one or more rails fixed in a hoistway;

an elevator car configured to move through the hoistway along the one or more rails;

one or more braking systems including:

a first braking surface secured to the elevator car and frictionally engageable with a first side of a rail of the elevator system;

a second braking surface secured to the elevator car and frictionally engageable with a second side of the rail, opposite the first side;

a braking actuator operably connected to the first braking surface configured to urge engagement or disengagement of the first braking surface with the rail to stop and/or hold the elevator car during operation of the elevator system, wherein the braking actuator is a solenoid; and a safety of the elevator operably connected to the second braking surface; wherein the second braking surface is operably connected to and translatable along a braking device slot via a pin disposed in the braking device slot and operably connected to the safety, the braking device slot is positioned nonparallel to the rail;

wherein the second braking surface is movable along the braking system parallel to the slot via a safety actuator and via frictional interaction with the rail, the second braking surface urging movement of one or more surfaces of the safety into engagement with the rail; and wherein the braking system is asymmetric about a longitudinal axis disposed at a centerline of the rail.

6. The elevator system of claim 5, including a plunger associated with the solenoid configured to urge the first braking surface into contact with the rail.

7. The elevator system of claim 5, including one or more plunger springs configured to urge the first braking surface into contact with the rails.

8. The braking system of claim 5, wherein the first safety surface includes a safety wedge.

* * * * *